US005670476A

United States Patent [19]

Vogel et al.

[11] Patent Number: 5,670,476

[45] Date of Patent: *Sep. 23, 1997

[54] FABRIC SOFTENING COMPOSITIONS CONTAINING MIXTURES OF SUBSTITUTED IMIDAZOLINE FABRIC SOFTENER MATERIALS AND HIGHLY ETHOXYLATED CURD DISPERSANT

[75] Inventors: Alice Marie Vogel, West Chester; Jeffrey Wayne Watson; Errol Hoffman Wahl, both of Cincinnati; Fernando Benvegnu, Maineville; John Cort Severns, West Chester, all of Ohio

[73] Assignee: The Procter & Gamble Company, Cincinnati, Ohio

[ * ] Notice: The term of this patent shall not extend beyond the expiration date of Pat. No. 5,368,756.

[21] Appl. No.: 598,143

[22] Filed: Feb. 7, 1996

Related U.S. Application Data

[63] Continuation of Ser. No. 353,734, Dec. 9, 1994, abandoned, which is a continuation of Ser. No. 128,044, Sep. 27, 1993, abandoned, which is a continuation of Ser. No. 849,136, Mar. 16, 1992, abandoned, which is a continuation-in-part of Ser. No. 693,493, Apr. 30, 1991, abandoned.

[51] Int. Cl.[6] ..... C11D 3/20; C11D 3/30; C11D 3/33

[52] U.S. Cl. ..... 510/500; 510/524; 510/506

[58] Field of Search ..... 252/8.6, 8.8, 8.9, 252/174.21, DIG. 1, 542; 510/524, 522, 500, 499, 506

[56] References Cited

U.S. PATENT DOCUMENTS

| | | | |
|---|---|---|---|
| 2,730,464 | 1/1956 | Winsor | 117/139.5 |
| 3,364,142 | 1/1968 | Buck | 252/8.8 |
| 3,896,033 | 7/1975 | Grimm, III | 252/8.6 |
| 3,962,152 | 6/1976 | Nicol et al. | 252/8.9 |
| 4,102,295 | 7/1978 | Minegishi et al. | 252/8.9 |
| 4,127,489 | 11/1978 | Pracht et al. | 252/8.8 |
| 4,128,485 | 12/1978 | Bauman et al. | 252/8.8 |
| 4,140,641 | 2/1979 | Ramachandran | 252/8.76 |
| 4,313,889 | 2/1982 | Bodor | 260/404 |
| 4,661,267 | 4/1987 | Dekker et al. | 252/8.8 |
| 4,661,269 | 4/1987 | Trinh et al. | 252/8.8 |
| 4,661,270 | 4/1987 | Grandmaire et al. | 252/8.75 |
| 4,678,590 | 7/1987 | Nakamura et al. | 252/8.8 |
| 4,701,268 | 10/1987 | Nelson et al. | 252/8.8 |
| 4,711,730 | 12/1987 | Gosselink et al. | 252/8.8 |
| 4,724,089 | 2/1988 | Konig et al. | 252/8.8 |
| 4,770,815 | 9/1988 | Baker et al. | 252/8.8 |
| 4,792,409 | 12/1988 | Sherman et al. | 252/8.6 |
| 4,806,255 | 2/1989 | Konig et al. | 252/8.8 |
| 4,818,421 | 4/1989 | Boris | 252/90 |
| 4,828,721 | 5/1989 | Bollier et al. | 252/8.6 |
| 4,851,141 | 7/1989 | Demangeon et al. | 252/8.75 |
| 4,855,072 | 8/1989 | Trinh et al. | 252/8.8 |
| 4,868,443 | 9/1989 | Rossi | 310/268 |
| 4,888,119 | 12/1989 | Klewsaat | 252/8.75 |
| 4,892,555 | 1/1990 | Leigh et al. | 8/101 |
| 4,897,208 | 1/1990 | Wahl et al. | 252/8.8 |
| 4,923,422 | 5/1990 | Capek et al. | 445/30 |
| 4,933,096 | 6/1990 | Demeyere et al. | 252/8.8 |
| 4,954,635 | 9/1990 | Rosario-Jansen et al. | 548/354 |
| 4,963,274 | 10/1990 | Ruback et al. | 252/8.75 |
| 4,968,443 | 11/1990 | Lambert et al. | 252/8.8 |
| 4,973,422 | 11/1990 | Schmidt | 252/8.8 |
| 4,976,878 | 12/1990 | Coffindaffer | 252/8.8 |
| 4,976,879 | 12/1990 | Maldonado et al. | 8/137 |
| 4,994,193 | 2/1991 | Wahl | 252/8.8 |
| 5,066,414 | 11/1991 | Chang | 252/8.8 |
| 5,154,841 | 10/1992 | Tucker et al. | 252/8.6 |
| 5,242,607 | 9/1993 | Yamamura et al. | 252/8.6 |
| 5,368,756 | 11/1994 | Vogel et al. | 252/8.8 |

FOREIGN PATENT DOCUMENTS

| | | | |
|---|---|---|---|
| 860980 | 3/1978 | Belgium . | |
| 0128231 | 12/1984 | European Pat. Off. . | |
| 0280550 | 8/1988 | European Pat. Off. . | |
| 404471 | 12/1990 | European Pat. Off. . | |
| 409503 | 1/1991 | European Pat. Off. . | |
| 510879 | 10/1992 | European Pat. Off. . | |
| 93433-A | 9/1985 | Romania | C08G 69/44 |
| 1565808 | 4/1980 | United Kingdom | D06M 13/36 |
| 019714 | 11/1992 | WIPO . | |
| 019714 | 9/1993 | WIPO . | |

*Primary Examiner*—Paul Lieberman
*Assistant Examiner*—John R. Hardee
*Attorney, Agent, or Firm*—Robert B. Aylor

[57] ABSTRACT

Rinse-added fabric softening compositions are provided comprising mixtures of a substituted imidazoline fabric softener material and a highly ethoxylated hydrophobic material as a scum dispersant to prevent the formation of scum by interaction of the substituted imidazoline fabric softener material with anionic detergent surfactant and/or phosphate detergency builder entrapped in the fabric, and a liquid carrier. These, preferably biodegradable, compositions have good product stability, dispersibility, and concentratability, as well as excellent fabric softening characteristics.

10 Claims, No Drawings

FABRIC SOFTENING COMPOSITIONS CONTAINING MIXTURES OF SUBSTITUTED IMIDAZOLINE FABRIC SOFTENER MATERIALS AND HIGHLY ETHOXYLATED CURD DISPERSANT

This is a continuation of application Ser. No. 08/353,734, filed on Dec. 9, 1994, which is a continuation of application Ser. No. 08/128,044, filed on Sep. 27, 1993, now abandoned; which is a continuation of application Ser. No. 07/849,136, filed Mar. 16, 1992, now abandoned; which is a continuation in part of application Ser. No. 07/693,493, filed Apr. 10, 1991, now abandoned.

TECHNICAL FIELD

The present invention relates to textile treatment compositions. In particular, it relates to textile treatment compositions for use in the rinse cycle of a textile laundering operation to provide fabric softening/static control benefits. The compositions are characterized by excellent softening performance and, preferably, biodegradability.

BACKGROUND OF THE INVENTION

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are ditallow alkyl dimethyl ammonium chloride and imidazolinium compounds substituted with two stearyl or tallow alkyl groups. These materials are normally prepared in the form of a dispersion in water.

It is highly desirable to prepare physically-acceptable textile treatment compositions containing biodegradable, water-insoluble, softener materials that exhibit excellent softening performance. However, materials which are biodegradable are often difficult to formulate as stable liquid compositions, especially at high concentrations.

The use of various quaternized ester-ammonium salts as cationic fabric softening agents is known in the art. See, for example, U.S. Pat. No. 4,339,391, Hoffmann et al., issued Jul. 13, 1982, for a series of quaternized ester-ammonium salts which function as fabric softeners. Various quaternized ester-ammonium salts are commercially available under the trade names SYNPROLAM FS from ICI and REWOQUAT from REWO. Similarly, methods for preparing various quaternized ester-amine compounds are known in the art. See, for example, U.S. Pat. No. 3,342,840, Sobolev, issued Sept. 19, 1967, U.S. Pat. No. 3,872,138, Ogatu, issued Mar. 18, 1975, and Japanese Laid Open Publication 49-1510, assigned to Gosei Chem. Ind. Co., published Jan. 9, 1974.

Another class of nitrogenous materials that is sometimes used as the active component in rinse-added fabric softening compositions comprises nonquaternary materials, e.g., amide-amines and ester-amines. A commonly used material is the reaction product of higher fatty acids with a polyamine selected from the group consisting of hydroxyalkylenediamines and dialkylenetriamines and mixtures thereof. An example of these materials is the reaction product of higher fatty acids and (N-hydroxyethyl)ethylene-diamine (see "Condensation Products from β-Hydroxyethylethylenediamine and Fatty Acids or Their Alkyl Esters and Their Application as Textile Softeners in Washing Agents," H. W. Eckert, Fette-Seifen-Anstrichmittel, September 1972, pages 527–533). These materials, along with other cationic quaternary ammonium salts and imidazolinium salts, are taught to be softening actives in fabric softening compositions. (See, for example, U.S. Pat. Nos. 4,460,485, Rapisarda et al., issued Jul. 17, 1984; 4,421,792, Rudy et al., issued Dec. 20, 1983; and 4,327,133, Rudy et al., issued Apr. 27, 1982.)

The use of various imidazoline derivatives as fabric conditioning agents is known. For example, British Patent Specification 1,565,808, published Apr. 23, 1980, discloses textile fabric softener compositions consisting of an aqueous dispersion of imidazoline ester derivatives. Similarly, methods for preparing various imidazoline derivatives are known in the art. See for example, U.S. Pat. No. 4,233,451, Pracht, issued Nov. 11, 1980, U.S. Pat. No. 4,189,593, Wechsler et al., issued Feb. 19, 1980, and Japanese Laid Open Publication 61-291571.

U.S. Pat. No. 4,661,269, Trinh et al., issued Apr. 28, 1987, discloses fabric softening compositions containing the reaction products of higher fatty acids with a polyamine selected from the group consisting of (hydroxyalkyl) alkylenediamines, dialkylenetriamines, and mixtures thereof, and cationic nitrogenous salts having only one long chain acyclic aliphatic $C_{15}$–$C_{22}$ hydrocarbon group.

Various solutions to the problem of preparing concentrated fabric softening compositions suitable for consumer use have been addressed in the art. See, for example, U.S. Pat. Nos.: 4,426,299, issued Jan. 17, 1984, and 4,401,578, issued Aug. 30, 1983, Verbruggen, which relate to paraffin, fatty acids and ester extenders in softener concentrates as viscosity control agents.

European Patent 0,018,039, Clint et al., issued Mar. 7, 1984, relates to hydrocarbons plus soluble cationic or nonionic surfactants in softener concentrates to improve viscosity and stability characteristics.

U.S. Pat. No. 4,454,049, MacGilp et al., issued Jun. 12, 1984, discloses concentrated liquid textile treatment compositions in the form of isotropic solutions comprising water-insoluble di-$C_{16}$–$C_{24}$ optionally hydroxy-substituted alkyl, alkaryl or alkenyl cationic fabric softeners, at least about 70% of the fabric softener consisting of one or more components together having a melting completion temperature of less than about 20° C., a water-insoluble nonionic extender, especially $C_{10}$–$C_{40}$ hydrocarbons or esters of mono- or polyhydric alcohols with $C_8$–$C_{24}$ fatty acids, and a water-miscible organic solvent. The concentrates have improved formulation stability and dispersibility, combined with excellent fabric softening characteristics.

U.S. Pat. No. 4,439,330, Ooms, issued Mar. 27, 1984, teaches concentrated fabric softeners comprising ethoxylated amines.

U.S. Pat. No. 4,476,031, Ooms, issued Oct.9, 1984, teaches ethoxylated amines or protonated derivatives thereof, in combination with ammonium, imidazolinium, and like materials.

The use of alkoxylated amines, as a class, in softener compositions is known (see, for example, German Patent Applications 2,829,022, Jakobi and Schmadel, published Jan. 10, 1980, and 1,619,043, Mueller et al., published Oct. 30, 1969, and U.S. Pat. Nos.: 4,076,632, Davis, issued Feb. 28, 1978, and 4,157,307, Jaeger et al., issued Jun. 5, 1979).

U.S. Pat. No. 4,422,949, Ooms, issued Dec. 27, 1983, relates to softener concentrates based on ditallow dimethyl ammonium chloride (DTDMAC), glycerol monostearate and polycationics.

In United Kingdom Application, 2,007,734A, Sherman et al., published May 23, 1979, fabric softener concentrates are disclosed which contain a mixture of fatty quaternary ammonium salts having at least one $C_8$–$C_{30}$ alkyl substituent and an oil or substantially water-insoluble compound having oily/fatty properties. The concentrates are said to be easily dispersed/emulsified in cold water to form fabric softening compositions.

Concentrated dispersions of softener material can be prepared as described in European Patent Application 0,000,406 and United Kingdom Patent Specification 1,601,360, Goffinet, published Oct. 28, 1981, by incorporating certain nonionic adjunct softening materials therein.

As can be seen, the various solutions to the specific problem of preparing fabric softening compositions in concentrated form suitable for consumer use have not been entirely satisfactory. It is generally known (for example, in U.S. Pat. No. 3,681,241, Rudy, issued Aug. 1, 1972) that the presence of ionizable salts in softener compositions does help reduce viscosity. This approach, however, is ineffective in compositions containing more than about 12% of dispersed softener, inasmuch as the level of ionizable salts necessary to reduce viscosity to any substantial degree has a seriously detrimental effect on product stability.

All of the above patents, patent applications, and publications are incorporated herein by reference.

It has now been discovered that fabric softener compositions containing substituted imidazoline fabric softener materials interact with anionic surfactants and detergency builders that are carried over into the rinse cycle to form surprisingly high levels of undesirable scum. This invention provides a way to avoid the formation of said scum without compromising the, e.g., biodegradable benefits and/or good fabric softening performance of the imidazoline materials.

SUMMARY OF THE INVENTION

The present invention provides a liquid, preferably biodegradable, fabric softening composition in the form of an aqueous dispersion comprising:

(a) from about 1% to about 35% by weight of substituted imidazoline fabric softener material, e.g., softening compound having the formula:

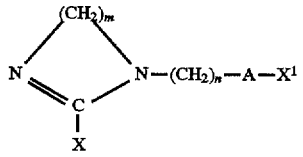

wherein: each A is either (1) —N(R)C(O)— wherein each R is a $C_1$–$C_6$ alkyl, alkenyl, hydroxy alkyl or hydrogen, or (2) —OC(O)—, or (3) a single covalent bond; X and $X^1$ are, independently, $C_{11}$–$C_{21}$ hydrocarbyl groups; and m and n are, independently, from about 2 to about 4; and (b) from about 0.2%, preferably 0.5%, to about 12% of a scum dispersant material containing at least about 17 ethoxy groups per molecule on the average to minimize the formation of scum by the interaction of (a) and anionic detergent surfactant and/or detergency builder, said scum dispersant material preferably being a highly ethoxylated hydrophobic material selected from the group consisting of:

(1) polyethoxylated fatty alcohols containing from about 12 to about 30 carbon atoms in the alcohol portion;

(2) polyethoxylated fatty acids containing from about 12 to about 30 carbon atoms in the fatty acid portion;

(3) polyethoxylated fatty amines containing from about 12 to about 30 carbon atoms with at least about 12 carbon atoms in one alkyl group;

(4) polyethoxylated fatty acid amides wherein said fatty acid contains from about 12 to about 30 carbon atoms;

(5) polyethoxylated quaternary ammonium compounds which contain from about 15 to about 30 carbon atoms with at least about 12 carbon atoms in one alkyl group;

(6) polyethoxylated amine oxides containing from about 14 to about 30 carbon atoms with at least about 12 carbon atoms in one alkyl group;

(7) polyethoxylate soil release polymers; and (8) mixtures thereof; and (c) from about 58%, preferably about 60%, to about 98% of aqueous liquid carrier.

The preferred ester linkage [A is —OC(O)—] lends biodegradability to the imidazoline softening compounds (a). When, preferably, only a single ester group is present, the preferred compounds have sufficient hydrolytic stability so that mixtures of the compounds can be stably formulated as liquid compositions, under the conditions disclosed hereinafter.

Compositions containing imidazoline ester compounds can be formulated at high softener active concentrations.

The preferred compositions of the present invention exhibit rapid biodegradability relative to compositions containing conventional fabric softening agents such as ditallow alkyl dimethyl ammonium chloride (DTDMAC).

The liquid compositions of the present invention are typically formulated at a neat pH of from about 1.8 to about 4, preferably at a pH of from about 1.8 to about 3.5, more preferably at a pH of from about 2 to about 2.5, to provide good storage stability.

The preferred liquid compositions herein have the fabric softener material (softening compounds) present as particles dispersed in the liquid carrier. The particles are preferably sub-micron size, generally having average diameters in the range of about 0.1 to 0.5 micron, preferably from about 0.1 to about 0.3 micron.

Water-dilutable fabric softener "concentrates" which contain from about 15% to about 35%, preferably from about 20% to about 28%, by weight of fabric softener active, can be conveniently packaged in containers, e.g., cartons or pouches, and can be diluted with water by the user to produce "single-strength" softeners (typically, 3–9% concentration of softener active).

All percentages, ratios and proportions herein are by weight, unless otherwise specified. All numbers are approximations unless otherwise stated.

DETAILED DESCRIPTION OF THE INVENTION

The compositions comprise a mixture of the fabric softener compounds (i.e., group (a) above), material (b) to minimize scum formation (scum dispersant), and (c) a liquid carrier. The weight ratio of the substituted imidazoline fabric softener material (a) to the scum dispersant (b) for optimum avoidance of scum formation is preferably in the range of from about 16:1 to about 1.9:1, preferably from about 12:1 to about 5:1, more preferably from about 10:1 to about 8:1. For a combination of minimizing scum formation while not adversely affecting softening, the ratio of (a) to (b) is from about 60:1 to about 9:1, more preferably from about 34:1 to about 17:1.

Substituted Imidazoline Softening Compound

The present invention contains as an essential component from about 1% to about 35% of substituted imidazoline fabric softener material, typically consisting essentially of a substituted imidazoline softening compound having the formula:

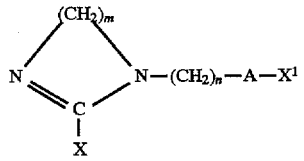

wherein each A is either —N(R)C(O)—, —OC(O)—, or a single covalent bond, preferably —OC(O); X and $X^1$ are, independently, hydrocarbyl, preferably alkyl, groups containing from about 11 to about 31, preferably from about 13 to about 17, carbon atoms, more preferably straight chain alkyl, and m and n are, independently, from about 2 to about 4, preferably with both m and n being 2. The total concentration of softener active should not exceed about 40% by weight. It will be understood that substituents X and $X^1$ can optionally be substituted with various groups such as alkoxyl or hydroxyl, or can be branched, but such materials are not preferred herein. In addition X and/or $X^1$ can optionally be unsaturated (i.e., alkenyl groups). The preferred substituted imidazoline ester softening compounds will hereinafter be referred to as di-alkyl imidazoline ester compounds.

The above compounds used as the primary active softener ingredient in the practice of this invention are prepared using standard reaction chemistry. Disclosure of imidazoline fabric softener compounds useful herein can be found in U.S. Pat. Nos.: 4,661,267, Dekker, Konig, Straathof, and Gosselink, issued Apr. 28, 1987; 4,724,089, Konig and Buzzaccarini, issued Feb. 9, 1988; 4,806,255, Konig and Buzzaccarini, issued Feb. 21, 1989; 4,855,072, Trinh, Wahl, Swartley, and Hemingway, issued Aug. 8, 1989; 4,933,096, DeMeyere, Hardy, and Konig, issued Jun. 12, 1990; and 4,954,635, Rosario-Jansen and Lichtenwalter, issued Sept. 4, 1990; all of said patents being incorporated herein by reference.

For example, in a typical synthesis of a substituted imidazoline ester softening compound of formula above, a fatty acid of the formula XCOOH is reacted with a hydroxyalkylenediamine of the formula $NH_2$—$(CH_2)_m$—NH—$(CH_2)_n$OH to form an intermediate imidazoline precursor, which is then reacted with a methyl ester of a fatty acid of the formula:

$X^1C(O)OCH_3$ to yield the desired reaction product (wherein X, $X^1$, m and n are as defined above). It will be appreciated by those of ordinary skill in the chemical arts that this reaction sequence allows a broad selection of compounds to be prepared. As illustrative, nonlimiting examples there can be mentioned the following di-alkyl imidazoline esters (wherein all long-chain alkyl substituents are straight-chain)): 1-stearyl oxyethyl-2-stearyl imidazoline, 1-stearyl oxyethyl-2-palmityl imidazoline, 1-stearyl oxyethyl-2-myristyl imidazoline, 1-palmityl oxyethyl-2-palmityl imidazoline, 1-palmityl oxyethyl-2-myristyl imidazoline, 1-stearyl oxyethyl-2-tallow imidazoline, 1-myristyl oxyethyl-2-tallow imidazoline, 1-palmityl oxyethyl-2-tallow imidazoline, 1-coconut oxyethyl 2-coconut imidazoline, 1-tallow oxyethyl-2-tallow imidazoline, and mixtures of such imidazoline compounds.

Other types of substituted imidazoline softening compounds can also be used herein. Examples of such compounds include:

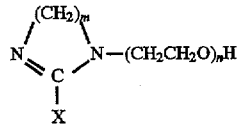

(i)

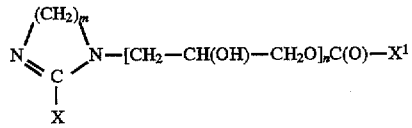

(ii)

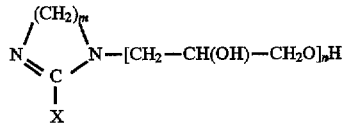

(iii)

wherein X, $X^1$, m and n are as previously defined. The above list is intended to be illustrative of other types of substituted imidazoline softening compounds which can optionally be used in the present invention, but which are not preferred.

The Scum Dispersant Material

The scum dispersant materials herein are formed by highly ethoxylating hydrophobic materials. The hydrophobic material can be a fatty alcohol, fatty acid, fatty amine, fatty acid amide, amine oxide, quaternary ammonium compound, and/or the hydrophobic moieties used to form soil release polymers. The preferred materials are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The preferred hydrophobic moiety is derived from a fatty alcohol containing from about 12 to about 22, preferably from about 14 to about 18, carbon atoms. Suitable fatty alcohols are those prepared by hydrogenating tallow and/or palm stearine fatty acids. Such fatty alcohol polyethoxylates, when they contain at least about 40 ethoxy moieties, provide scum dispersant properties. Typical materials include stearyl alcohol polyethoxylate(100) and hydrogenated tallow alcohol polyethoxylate(50).

Other hydrophobic moieties can be derived from fatty acids and/or fatty acid amides in which the fatty acids contain from about 12 to about 22, preferably from about 14 to about 18, carbon atoms. The amide can be a primary (ammonia) amide (preferable), or can be substituted with one or two alkyl, or hydroxyalkyl groups containing from one to about six carbon atoms. The amide must contain at least one reactive hydrogen atom to allow ethoxylation.

Other hydrophobic materials that can be ethoxylated include nitrogen-containing compounds such as amines, amine oxides, and/or quaternary ammonium compounds with a single long hydrophobic, preferably alkyl or alkenyl, most preferably alkyl, group having the same carbon content as the fatty alcohol and/or fatty acid groups described hereinbefore. The additional substituents on the nitrogen, if any, are alkyl, or hydroxyalkyl groups containing from one to about six, preferably from about one to about two, carbon atoms. As with the fatty acid amide, the nitrogen-containing compounds must contain at least one reactive hydrogen atom to allow ethoxylation to occur.

All of the above compounds are typically prepared with essentially the same length of alkyl hydrophobic group and essentially the same ethoxylation content. Generically, these scum dispersants are polyethoxylated hydrophobic materials containing at least one hydrophobic group containing at least about 12 carbon atoms, preferably alkyl (optionally including alkenyl), and at least about 20, preferably at least about 25, more preferably at least about 40, ethoxy units (More than about 50 and more than about 100 ethoxy groups can provide superior scum reduction.). The total carbon content in the hydrophobic portion is usually less than about 30 atoms, preferably less than about 20 atoms.

Another group of compounds that can be used as scum dispersants are also used as "soil release" materials. The soil release material must contain the same amount of ethoxylation as the other materials, but the hydrophobic portion is an oligomer unit, or units, which are hydrophobic and contain the same monomers used to form polyester, polyamide, etc., fibers. Such soil release materials are well known and suitable materials are described in U.S. Pat. Nos.: 4,711,730, Gosselink and Diehl, issued Dec. 8, 1987; 4,749,596, Evans, Huntington, Stewart, Wolf, and Zimmerer, issued Jun. 7, 1988; 4,818,569, Trinh, Gosselink, and Rattinger, issued Apr. 4, 1989; 4,877,896, Maldonado, Trinh, and Gosselink, issued Oct. 31, 1989; 4,956,447, Gosselink et al., issued Sept. 11, 1990; and 4,976,879, Maldonado, Trinh, and Gosselink, issued Dec. 11, 1990, all of said patents being incorporated herein by reference.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from Dupont) and Milease® T (from ICI).

Highly preferred soil release agents are polymers of the generic formula:

$$R—[O—D^2—O—C(O)—D^1—C(O)—]_xO—(CH_2CH_2O)_n—[C(O)—D^1—C(O)—O—D^2—O]_y—R$$

wherein $D^1$ is a phenylene group; $D^2$ is a $—CH_2CH(CH_3)—$ group; each R is selected from the group consisting of H and $—C(O)D^1—SO_3M$ where M is a compatible cation, typically H; n is selected for water solubility and each n is generally from about 20 to about 150, preferably from about 50 to about 100; and the sum of x and y, which is critical to formulation in a liquid composition having a relatively high ionic strength, being from about 6 to about 12, with preferably x and y being less than about 10.

The $D^1$ moieties are essentially 1,4-phenylene moieties. As used herein, the term "the $D^1$ moieties are essentially 1,4-phenylene moieties" refers to compounds where the $D^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $D^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $D^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $D^1$ moieties consist entirely of (i.e., comprise 100%) 1,4-phenylene moieties, i.e., each $D^1$ moiety is 1,4-phenylene.

For the $D^2$ moieties, suitable ethylene or substituted ethylene moieties include: ethylene; 1,2-propylene; 1,2-butylene; 1,2-hexylene; 3-methoxy-1,2-propylene; and mixtures thereof. Preferably, the $D^2$ moieties are essentially ethylene moieties, 1,2-propylene moieties or mixtures thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $D^2$ moieties are 1,2-propylene moieties.

The value for each n is at least about 6, and preferably is at least about 10. The value for each n usually ranges from about 12 to about 113. Typically, the value for each n is in the range of from about 12 to about 43.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending upon the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and/or detergency builder (especially phosphates) entrapped in the fabric (laundry) will vary. Normally, the minimum amount of scum dispersant material should be used to avoid adversely affecting softening properties. Typically scum dispersion requires at least about 2%, preferably at least about 4% (at least 6% and at least 10% for maximum scum avoidance) based upon the level of the substituted imidazoline fabric softener material. However, at levels of about 10% (relative to the softener material) or more, one risks loss of softening efficacy of the product especially when the fabrics contain high proportions of nonionic surfactant which has been absorbed during the washing operation. When the ratio of softener to scum dispersant is maintained within the weight ratio ranges set forth hereinbefore, softening is normally acceptable.

Preferred scum dispersants are: Brij® 700; Varonic® U-250; Genapol® T-500; Genapol® T-800; Plurafac® A-79; and Neodol® 25-50.

Liquid Carrier

The compositions herein comprise a liquid carrier, e.g., water. These compositions comprise from about 60% to about 98%, preferably from about 70% to about 95% of the liquid carrier.

The imidazoline softening compounds used in this invention are in such water-based carriers and, thus, are present as a dispersion of fine particles therein. These particles are sub-micron, preferably having average diameters of from about 0.1 to about 0.5, more preferably from about 0.1 to about 0.3, micron in size and are conveniently prepared by high-shear mixing which disperses the compounds as fine particles. A method of preparation of a preferred dispersion is disclosed in detail in Examples I–III hereinafter. Again, since the preferred ester softening compounds are hydrolytically labile, care should be taken to avoid the presence of base with such compounds, and to keep the processing temperatures and pH within the ranges specified herein.

Optional Ingredients

Fully-formulated fabric softening compositions can optionally contain, in addition to the biodegradable, substituted imidazoline ester softening compounds of the formulas herein, and liquid carrier, one or more of the following ingredients.

Silicone Component

The fabric softening compositions herein optionally contain an aqueous emulsion of a predominantly linear polydialkyl or alkyl aryl siloxane in which the alkyl groups can have from one to five carbon atoms and can be wholly, or partially, fluoridated. These siloxanes act to provide improved fabric benefits. Suitable silicones are polydimethyl siloxanes having a viscosity, at 25° C., of from about 1 to about 100,000 centistokes, preferably from about 1,000 to about 12,000 centistokes. For certain applications, e.g., concentrated formulas, siloxanes with a viscosity of as low as 1 centistoke are preferred.

The fabric softening compositions herein can contain up to about 15%, preferably from about 0.1% to about 10%, of the silicone component.

Thickening Agent

Optionally, the compositions herein contain from 0% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein can be characterized as certain hydroxyethers of cellulose, such as Methocel®, marketed by Dow Chemicals, Inc.; also, certain cationic cellulose ether derivatives, such as Polymer JR-125®, JR-400®, and JR-30M , marketed by Union Carbide.

Other effective thickening agents are cationic guar gums, such as Jaguar Plus®, marketed by Stein Hall, and Gendrive® 458, marketed by General Mills.

Preferred thickening agents herein are selected from the group consisting of methyl cellulose, hydroxypropyl methylcellulose, hydroxybutyl methylcellulose, or mixtures thereof, said cellulosic polymer having a viscosity in 2% aqueous solution at 20° C. of from about 15 to about 75,000 centipoises.

Viscosity Control Agents

Viscosity control agents can be used in the compositions of the present invention (preferably in concentrated compositions). Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts include sodium citrate and the halides of the group IA and IIA metals of the Periodic Table of the Elements, e.g., calcium chloride, magnesium chloride, sodium chloride, potassium bromide and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator.

In addition to their role as viscosity agents, the ionizable salts mentioned above also function as electrolytes and can further improve the stability of the compositions herein. A highly preferred electrolyte is calcium chloride.

Typical levels of use of the electrolyte are from about 20 to about 15,000 parts per million (ppm), preferably from about 20 to about 10,000 ppm by weight of the compositions. Maximums of 6,000 ppm and 4,000 ppm are desirable for some compositions.

Bactericides

Examples of bactericides used in the compositions of this invention include glutaraldehyde, formaldehyde, 2-bromo-2-nitropropane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bactericides used in the present compositions are from about 1 to about 1,000 ppm by weight of the composition.

Other Optional Ingredients

The present invention can include other optional components conventionally used in textile treatment compositions, for example, colorants, perfumes, preservatives, optical brighteners, opacifiers, surfactants, stabilizers such as guar gum and polyethylene glycol, anti-shrinkage agents, anti-wrinkle agents, fabric crisping agents, spotting agents, germicides, fungicides, anti-oxidants such as butylated hydroxy toluene, anti-corrosion agents, and the like.

In the method aspect of this invention, fabrics or fibers (including hair) are contacted with an effective amount, generally from about 20 ml to about 300 ml (per 3.5 kg of fiber or fabric being treated), of the compositions herein in an aqueous bath. Of course, the amount used is based upon the judgment of the user, depending on concentration of the composition, fiber or fabric type, degree of softness desired, and the like. Typically, from about 60 to about 250 ml. of a 8% dispersion of the softening compounds are used in a 25 gallon laundry rinse bath to soften and provide antistatic benefits to a 3.5 kg load of mixed fabrics. Preferably, the rinse bath contains from about 25 ppm to about 300 ppm, preferably from about 40 ppm to about 100 ppm, of the fabric softening compounds herein.

The following examples illustrate the practice of the present invention but are not intended to be limiting thereof.

| Ingredient | Percent (wt.) |
|---|---|
| 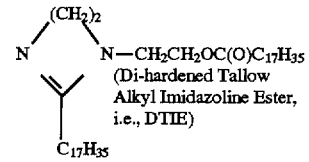 (Di-hardened Tallow Alkyl Imidazoline Ester, i.e., DTIE) | 7.74 |
| Stearyl Alcohol Polyethoxylate (100) | 0.75 |
| HCl | 0.51 |
| Dye Solution | 0.10 |
| Perfume | 0.42 |
| Polydimethyl Silicone (PDMS) (55%) | 0.18 |
| Antifoam (10%) | 0.015 |
| Deionized Water | 90.29 |

Based on 1,000 g of finished product, 77.4 g of the biodegradable dialkyl imidazoline ester softening compound, and 7.5 g of the stearyl alcohol polyethoxylate (100) are heated to 80° C. and mixed to form a fluidized "melt." The molten mixture is added to a 903 g water seat, preheated to 75° C. and containing 5.1 g HCl and 0.15 g antifoam, with high shear mixing over 3 minutes. 4.2 g perfume is added at 65°–70° C., and the dispersion is mixed for 2.5 minutes at 7,000 rpm (Tekmar high shear mixer). 1.8 g PDMS is added, and the product is then cooled to 25°–30° C. 1.0 g dye is added after cooling. The resulting dispersion will have a viscosity of 10–20 cps and a pH of about 2.2 at 25° C.

| Ingredient | Percent (wt.) |
|---|---|
| DTIE | 7.74 |
| Stearic Alcohol Polyethoxylate (50) | 0.75 |
| HCl | 0.51 |
| Dye Solution | 0.10 |
| Perfume | 0.42 |
| PDMS (55%) | 0.18 |
| Antifoam | 0.015 |
| Deionized Water | 90.29 |

Based on 1,000 g of finished product, 77.4 g of the biodegradable dialkyl imidazoline ester softening compound, and 7.5 g of the stearyl alcohol polyethoxylate (50) are heated to 80° C. and mixed to form a fluidized "melt." The molten mixture is added to a 903 g water seat, preheated to 75° C. and containing 5.1 g HCl and 0.15 g antifoam, with high shear mixing over 3 minutes. 4.2 g perfume is added at 65°–70° C., and the dispersion is mixed for 2.5 minutes at 7,000 rpm (Tekmar high shear mixer). 1.8 g PDMS is added, and the product is then cooled to 25°–30° C. 1.0 g dye is added after cooling. The resulting dispersion will have a viscosity of 10–20 cps and a pH of about 2.2 at 25° C.

| Ingredient | Percent (wt.) |
|---|---|
| Di-Hardened Tallow Imidazoline Ester | 23.60 |
| Tallow Alcohol Polyethoxylate (50) | 1.00 |
| Polyethoxylate Polyester Soil Release Polymer | 0.75 |
| HCl | 1.58 |
| Dye Solution | 0.04 |
| Perfume | 1.20 |
| DC-200 Silicone | 0.19 |
| Antifoam (10%) | 0.04 |

-continued

| Ingredient | Percent (wt.) |
|---|---|
| $CaCl_2$ | 4.40 |
| Deionized Water | 67.18 |

Based on 1,000 g of finished product, 236 g of the biodegradable dialkyl imidazoline ester softening compound, 10 g of the tallow alcohol polyethoxylate (50), and 7.5 g polyethoxylate polyester soil release polymer are heated to 80° C. and mixed to form a fluidized "melt." The molten mixture is added to a 300 g water seat, preheated to 75° C. and containing 15.8 g HCl and 0.4 g antifoam, with high shear mixing over 6 minutes. After additional mixing time, 12.0 g perfume and 1.9 g silicone oil are mixed together and added at 65°–70° C. The remaining 372 g of water (80°–85° C.) is then added in 3 aliquots, alternately with 3 aliquots of 2.2 g $CaCl_2$. The dispersion is mixed for 2.5 minutes at 6000 rpm (Tekmar high shear mixer). The product is then cooled to 25°–30° C., and 0.4 g dye solution is added after cooling. The resulting dispersion will have a viscosity of 60–80 cps and a pH of about 2.0 at 25° C. The average particle size in the dispersion is about 0.2 micron.

| Ingredient | Percent (wt.) |
|---|---|
| DTIE | 19.8 |
| Tallow Alkylamine Polyethoxylate (50) | 3.00 |
| HCl | 1.30 |
| Dye Solution | 0.24 |
| Perfume | 1.20 |
| DC-200 Silicone | 0.19 |
| $CaCl_2$ | 0.35 |
| Deionized Water | 73.92 |

Based on 1,000 g of finished product, 198 g of the biodegradable dialkyl imidazoline ester softening compound, and 30 g of tallow alkylamine polyethoxylate (50) are heated to 80° C. and mixed to form a fluidized "melt." The molten mixture is added to a 739 g water seat, preheated to 75° C. and containing 13 g HCl, with high shear mixing over 5 minutes. 3.5 g $CaCl_2$ is added in 5 equal amounts during the mixing. The dispersion is mixed for 2.5 minutes at 7,000 rpm (Tekmar high shear mixer). 12 g perfume and 1.9 g DC-200 are mixed and added at 76°–70° C., and the product is then cooled to 25°–30° C. 2.4 g dye is added after cooling. The resulting dispersion will have a viscosity of 60–70 cps and a pH of about 2.2 at 25° C.

| Ingredient | Percent (wt.) |
|---|---|
| Di-Hardened Tallow Imidazoline Ester | 7.74 |
| Tallow Alcohol Polyethoxylate (50) | 0.33 |
| HCl | 0.51 |
| Dye | 0.03 |
| Perfume | 0.40 |
| PDMS (55%) | 0.18 |
| Antifoam (10%) | 0.04 |
| Deionized Water | 90.77 |

Based on 1,000 g of finished product, 77.4 g of the biodegradable dialkyl imidazoline ester softening compound, and 3.3 of the tallow alcohol polyethoxylate (50) are heated to 80° C. and mixed to form a fluidized "melt." The molten mixture is added to a 908 g water seat, preheated to 75° C. and containing 5.1 g HCl and 0.4 g antifoam, with high shear mixing over 3 minutes. 4.0 g perfume is added at 65°–70° C., and the dispersion is mixed for 2.5 minutes at 7000 rpm (Tekmar high shear mixer). 1.8 g PDMS is added, and the product is then cooled to 25°–30° C. 0.3 g dye is added after cooling. The resulting dispersion will have a viscosity of 10–20 cps. and a pH of about 2.2 at 25° C. The average particle size in the dispersion is about 0.2 micron.

PREDICTIVE EXAMPLE VI

Aqueous solutions are prepared simulating rinse water conditions and product dosing levels for a composition which contains 7.74-hardened tallow imidazoline ester and the indicated percentages of the scum dispersant. The solutions below give a level of scum that predicts that consumers will not find the level of scum in actual use to be unacceptable.

| Scum Dispersant | Wt. % | Chemical Name |
|---|---|---|
| Brij ® 700 | 1.00 | Stearyl alcohol polyethoxylate (100) |
| Brij ® 700 | 0.75 | Stearyl alcohol polyethoxylate (100) |
| Brij ® 700 | 0.63 | Stearyl alcohol polyethoxylate (100) |
| Myrj ® 53 | 1.00 | Stearate acid polyethoxylate (50) |
| Myrj ® 53 | 0.75 | Stearate acid polyethoxylate (50) |
| Genapol ® T-800 | 0.75 | Tallow alcohol polyethoxylate (80) |
| Genapol ® T-500 | 0.75 | Tallow alcohol polyethoxylate (50) |
| Genapol ® T-250 | 0.75 | Tallow alcohol polyethoxylate (25) |
| Brij ® 700 | 0.50 | Stearyl alcohol polyethoxylate (100) |
| Varonic ® U-250 | 1.00 | Hardened tallow alkyl amine polyethoxylate (50) |
| Plurafac ® A-39 | 0.75 | Cetearyl alcohol polyethoxylate (55) |
| Varonic ® U-250 | 0.75 | Hardened tallow alkyl amine polyethoxylate (50) |
| Neodol ® 25-20 | 1.00 | Primary alcohol ($C_{12}$–$C_{15}$) polyethoxylate (20) |
| Varonic ® T220-D | 1.00 | Soft tallow alkyl amind polyethoxylate (20) |
| Varonic ® U-2100 | 0.75 | Hardened tallow alkyl amine polyethoxylate (100) |
| Varonic ® U-2200 | 0.75 | Hardened tallow alkyl amine polyethoxylate (200) |
| Neodol ® 25-20 | 0.75 | Primary alcohol ($C_{12}$–$C_{15}$) polyethoxylate (20) |
| Variquat ® 66 | 1.00 | Tallow alkyl bis(polyethoxy)ethyl ammonium, ethyl sulfate ethoxylate (~17) |
| Variquat ® 66 (Hard Tallow) | 1.00 | Hardened tallow alkyl bis(polyethoxy)ethyl ammonium, ethyl sulfate ethoxylate (~17) |
| Brij ® 78 | 1.00 | Stearyl alcohol polyethoxylate (20) |
| Brij ® 35 | 0.75 | Lauryl alcohol polyethoxylate (20) |
| — | 1.00 | Tallow alkyl aminopropylamine polyethoxylate (50) |
| — | 1.00 | Tallow fatty acid amine polyethoxylate (50) |
| — | 1.00 | Stearylamine oxide polyethoxylate (50) |
| Neat Soil Release Polymer | 1.00 | Polyethoxy (77) propylene glycol terephthalate (8) block oligopolymer, sulfobenzoic acid sodium salt capped |
| Neat Soil Release Polymer/Tallow Fatty Acid Blend | 1.00 | 75% Neat soil release polymer/25% tallow fatty acid blend |

| Example: Component | VII Wt. % | VIII Wt. % | IX Wt. % | X Wt. % |
|---|---|---|---|---|
| Di-Hardened Tallow Imidazoline Ester | 7.82 | 7.79 | 7.83 | 7.69 |
| HCl (25%) | 2.28 | 2.14 | 2.04 | 2.05 |
| PDMS (55%) | 0.18 | 0.18 | 0.18 | 0.18 |
| Perfume | 0.40 | 0.40 | 0.40 | 0.40 |
| Antifoam (10%) | 0.015 | 0.015 | 0.015 | 0.015 |
| Acid Blue Dye 127:1 | 0.0015 | 0.0015 | 0.0015 | 0.0015 |
| Varonic ® T220-D | 1.00 | — | — | — |
| Varonic ® U-250 | — | 1.00 | — | — |
| Brij ® 700 | — | — | 0.75 | — |
| Myrj ® 53 | — | — | — | 0.75 |
| Deionized Water | Balance | Balance | Balance | Balance |

-continued

| Example: Component | XI Wt. % | XII Wt. % | XIII Wt. % |
|---|---|---|---|
| Di-Hardened Tallow Imidazoline Ester | 7.69 | 7.79 | 6.26 |
| HCl (25%) | 2.04 | 2.06 | 1.80 |
| PDMS (55%) | 0.18 | 0.18 | 0.18 |
| Perfume | 0.40 | 0.40 | 0.40 |
| Antifoam (10%) | 0.015 | 0.015 | 0.015 |
| Acid Blue Dye 127:1 | 0.0015 | 0.0015 | 0.0015 |
| Varonic ® U-250 | — | — | 0.80 |
| Variquat ® 66 | 1.00 | — | — |
| Neodol ® 25-20 | — | 1.00 | — |
| Deionized Water | Balance | Balance | Balance |

| Example: Component | XIV Wt. % | XV Wt. % | XVI Wt. % |
|---|---|---|---|
| Di-Hardened Tallow Imidazoline Ester | 19.9 | 19.9 | 19.9 |
| HCl (25%) | 5.40 | 5.20 | 5.03 |
| DC-200 Silicone ® | 0.19 | 0.19 | 0.19 |
| Perfume | 1.20 | 1.20 | 1.20 |
| Polyethoxylate Polyester Soil Release Polymer | 0.75 | 0.75 | 0.75 |
| Calcium Chloride | 0.43 | 0.43 | 0.43 |
| Acid Blue Dye 127:1 | 0.0032 | 0.0032 | 0.0032 |
| Varonic ® T220-D | 3.00 | — | — |
| Varonic ® U-250 | — | 3.00 | — |
| Brij ® 700 | — | — | 1.80 |
| Deionized Water | Balance | Balance | Balance |

| Example: Component | XVII Wt. % | XVIII Wt. % |
|---|---|---|
| Di-Hardened Tallow Imidazoline Ester | 23.6 | 23.6 |
| HCl (25%) | 6.20 | 6.00 |
| DC-200 Silicone ® | 0.19 | 0.19 |
| Perfume | 1.20 | 1.20 |
| Polyethoxylate Polyester Soil Release Polymer | 0.75 | 0.75 |
| Calcium Chloride | 0.60 | 0.60 |
| Acid Blue Dye 127:1 | 0.0032 | 0.0032 |
| Varonic ® U-250 | 3.00 | — |
| Brij ® 700 | — | 1.80 |
| Deionized Water | Balance | Balance |

What is claimed is:

1. Liquid fabric softening composition in the form of an aqueous dispersion comprising:

(a) from about 3% to about 30% of sub-micron size particles of substituted imidazoline fabric softener material which has the formula:

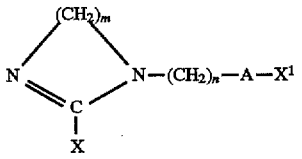

wherein: each A is either (1) —O—C(O)—, or (2) a single covalent bond, wherein each R is a $C_1C_6$ alkyl, alkenyl, hydroxy alkyl, or hydrogen, X and $X^1$ are, independently, $C_{11}$–$C_{21}$ hydrocarbyl groups; and m and n are, independently, from about 2 to about 4;

(b) from about 0.2% to about 3% of scum dispersant material, the said scum dispersant material being less than about 10% by weight of said substituted imidazoline fabric softener material which is highly ethoxylated hydrophobic material that minimizes the formation of scum by the interaction of (a) and any anionic detergent surfactant, detergency builder, or mixtures thereof, in water and wherein said scum dispersant material is selected from the group consisting of:

(1) polyethoxylated fatty alcohols containing from about 12 to about 30 carbons atoms in the alcohol portion;

(2) polyethoxylated fatty acids containing from about 12 to about 30 carbons atoms in the fatty acid portion;

(4) polyethoxylated fatty acid amides containing from about 12 to about 30 carbons atoms in the fatty acid portion;

(5) polyethoxylated quaternary ammonium compounds which contain from about 15 to about 30 carbons atoms in the quaternary ammonium compound with at least about 12 carbon atoms in one alkyl group;

(6) polyethoxylated amine oxides which contain from about 14 to about 30 carbons atoms in the amine oxide with at least about 12 carbon atoms in one alkyl group; and (7) mixtures thereof and contains at least about 17 ethoxy groups per molecule on the average and the polyethylene oxide portion of said scum dispersant material is less than about 97% by weight of the total molecular weight; and (c) from about 97% to about 59% of aqueous liquid carrier.

2. The composition of claim 1 wherein said scum dispersant material contains at least about 25 ethoxy groups per molecule on the average.

3. The composition of claim 2 wherein said scum dispersant material contains at least about 40 ethoxy groups per molecule on the average.

4. The composition of claim 2 wherein said scum dispersant material is polyethoxylated fatty alcohol (1) or fatty acid (2).

5. The composition of claim 1 wherein A is —OC(O)— and X and X' contain from about 13 to about 17 carbon atoms.

6. The composition of claim 5 wherein said scum dispersant material contains at least about 25 ethoxy groups per molecule on the average.

7. The composition of claim 6 wherein said scum dispersant material contains at least about 40 ethoxy groups per molecule on the average.

8. The composition of claim 6 wherein said scum dispersant material is polyethoxylated fatty alcohol (1) or fatty acid (2).

9. The process of preparing the composition of claim 1 wherein said substituted imidazoline fabric softener material and said scum dispersant material are homogeneously mixed as a melt before being added to said aqueous liquid carrier.

10. The process of claim 9 wherein the melt is added with high shear mixing to said aqueous liquid carrier to produce submicron particles.

* * * * *